US005255470A

United States Patent [19]

Dupuy

[11] Patent Number: 5,255,470

[45] Date of Patent: Oct. 26, 1993

[54] VEHICLE DOOR GLASS REGULATOR

[75] Inventor: Ronald E. Dupuy, Wabash, Ind.

[73] Assignee: GenCorp Inc., Fairlawn, Ohio

[21] Appl. No.: 902,628

[22] Filed: Jun. 23, 1992

[51] Int. Cl.[5] ..... E05F 11/52

[52] U.S. Cl. ..... 49/227; 49/351

[58] Field of Search ..... 49/227, 351, 349

[56] References Cited

U.S. PATENT DOCUMENTS

| | | | |
|---|---|---|---|
| 2,010,075 | 10/1933 | Graf . | |
| 2,544,451 | 3/1951 | Floraday . | |
| 2,552,671 | 5/1951 | Floraday | 49/351 |
| 2,934,785 | 5/1960 | Heuer . | |
| 3,020,040 | 2/1962 | King et al. . | |
| 3,072,395 | 1/1963 | Pickles . | |
| 3,143,340 | 8/1964 | Maslonka . | |
| 3,231,301 | 8/1966 | Gray . | |
| 3,897,652 | 8/1975 | Hess . | |
| 4,098,134 | 7/1978 | Kondo | 49/227 X |
| 4,120,120 | 10/1978 | Becker . | |
| 4,221,079 | 9/1980 | Becker . | |
| 4,329,816 | 5/1982 | Koike . | |
| 4,550,529 | 11/1985 | Drouillard . | |
| 4,586,290 | 5/1986 | Juechter . | |
| 4,653,230 | 3/1987 | Seo et al. | 49/227 X |
| 4,843,760 | 7/1989 | Hlousek . | |
| 4,998,379 | 3/1991 | Yamada et al. | 49/351 X |
| 5,027,555 | 7/1991 | Halliwell | 49/351 |

FOREIGN PATENT DOCUMENTS

| | | |
|---|---|---|
| 7611136 | 1/1976 | France . |

*Primary Examiner*—Philip C. Kannan

[57] ABSTRACT

The invention relates to a vehicle door glass regulator adapted for use with doors having a rearwardly angled B-pillar, wherein the mechanism forces of the regulator are directed parallel with the B-pillar to reduce undesirable forces due to inaccurate tracking. The regulator includes a curved or bent lift arm and two balance arms, one of which is pivotally connected at one end to an intermediate point on the lift arm and at the other end to a guideway on the door, the second pivotally connected at one end to the same intermediate point on the lift arm and at the other end to a guideway on the window. The sum of the angles defining the bend of the lift arm and the slant of the B-pillar is preferably about 180°, and the balance arms are preferably of equal length and form an angle about equal to that defining the bend of the lift arm.

17 Claims, 5 Drawing Sheets

VEHICLE DOOR GLASS REGULATOR

FIELD OF THE INVENTION

The invention relates to a vehicle door glass regulator and particularly to a regulator wherein the direction of the mechanism forces is parallel to an angled B-pillar.

BACKGROUND OF THE INVENTION

Vehicle door window regulators having a lift arm operatively connected to a motor or to a manual crank and a balance arm pivotally connected to the lift arm are well known in the art. An example of such a design is shown in U.S. Pat. No. 2,010,075 to Graf. The regulator includes a crossed lever arrangement wherein one end of a substantially straight lift lever is operated to pivot about a fixed point on the door with the other end of the lever having a roller or stud slidably engaging a horizontal channel connected to the bottom of the window. A substantially straight balance lever is pivotally connected at an intermediate point along its length to an intermediate point along the length of the lift lever. A roller at one end of the balance lever slidably engages the horizontal channel connected to the window while a second roller at the other end of the balance lever slidably engages a horizontal channel attached to the door.

While the foregoing arrangement has worked well with windows having vertical edges, current vehicle designs incorporate B-pillars (i.e., the door pillars at the trailing edge of the door window) which are rearwardly angled away from the vertical. For an angled B-pillar design, the window must have angled edges and move along an inclined path as it is being raised or lowered. The mechanism forces, i.e. the forces exerted on the window by the window regulator, of the described prior art regulator are generally along a vertical direction. Consequently, an unmodified regulator of this type would not be ideally suited for use in an automobile door having an angled B-pillar, as it would undesirably exert forces having a component perpendicular to the B-pillar, thereby subjecting the glass-run channel and weather-stripping along the B-pillar to undue forces. In addition to the weatherstripping, other components such as arm catchers, regulator arms and the regulator motor are deleteriously affected by the undesirable forces exerted on the B-pillar when the direction of the mechanism force of the regulator is not substantially parallel with the window opening edge of the B-pillar.

Additionally, contemporary vehicle designs incorporate side window glass panes which are curved about an axis of curvature generally parallel to the normal direction of forward motion of the vehicle and, more importantly, transverse to the direction of travel of the glass when the glass pane is raised or lowered. This curvature also induces undue stresses on the glass-run channel weatherstrips and regulator components when the mechanism forces are directed along a substantially vertical straight line as with the simple crossed lever arrangement. Various modifications have been made to the described crossed lever design; however, none of these specifically address or solve the problem of how to raise and lower a window, particularly a curved window, along an inclined path without exerting undesirable forces on the weatherstripping and other components.

SUMMARY OF THE INVENTION

The present invention relates to a vehicle door glass regulator utilizing lift and balance arms, wherein the mechanism forces are directed substantially parallel to an angled B-pillar edge so that the glass smoothly tracks along a path parallel with the forward or window opening edge of an angled B-pillar and does not exert undue forces on the weather stripping and regulator components. In particular, the invention provides a window regulator in which the magnitude of the forces transmitted through the rearward edge of the glass toward the B-pillar when the glass is raised or lowered is significantly less than with previously known regulators. These reduced forces result in less abrasion, and consequently a longer useful life, of the weather stripping. Moreover, stress on components of the window regulator, such as arm catchers and regulator arms, is significantly reduced, thereby facilitating potential cost savings on account of gauge reduction of components. The reduction of undesirable forces, alone or in combination with component gauge reduction, can provide additional cost savings through reduction in the size of the window regulator motor.

The invention utilizes a one piece bent lift arm having a sliding or rolling element, at one end, which engages a guideway fixedly connected to the glass, and is rotatably connected at the other end, to a fixed pivot point on the door. Two separate balance arms are each pivotally connected, at one end, to a central pivot point intermediate on the lift arm. A first balance arm is pivotally connected at its other end to the window pane, and the second balance arm at its other end, pivotally and slidably engages a guideway secured to an inner panel of the door. The bend of the lift arm is defined by the angle between the line connecting the point, at which the lift arm is attached to the glass, to the central pivot point, and the line connecting the central pivot point to the lift arm pivot point. In accordance with the invention, the bend of the lift arm is between 90° and 180°.

In accordance with one aspect of the invention, the use of flexible balance and lift arms reduces undesirable stresses, which are inwardly and outwardly directed substantially normal to a curved glass pane. Inboard and outboard forces are also reduced by the positioning of the central pivot point about midway between the vertical planes coincident with the longitudinal directions of the guideway secured to the door and the guideway secured to the window pane.

In accordance with another aspect of the invention, the regulator components are arranged so that the balance arms form an angle substantially equal to the lift arm angle, with the difference between 180° and the lift arm angle being about equal to the angle formed by the B-pillar and a vertical line. The resulting arrangement provides a mechanism force substantially parallel to the angle of the B-pillar so that minimal forces are exerted on the glass-run channels during movement of the window.

DESCRIPTION OF THE PREFERRED EMBODIMENT

Figure 1:
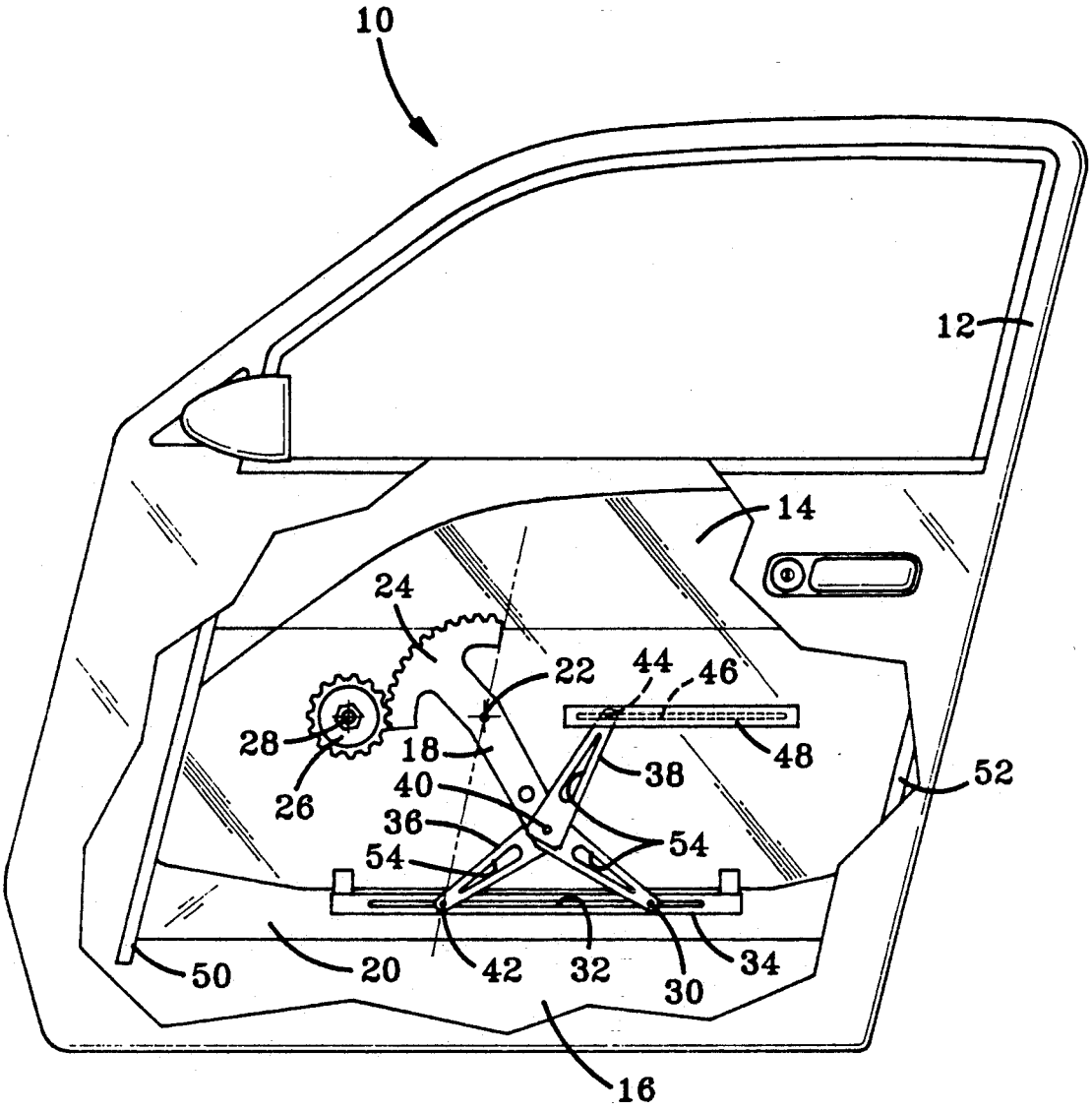
FIG. 1 is a side elevation view of a vehicle door having a movable pane with portions broken away to show the door window regulator when the glass is fully lowered into the door cavity.
Figure 5:
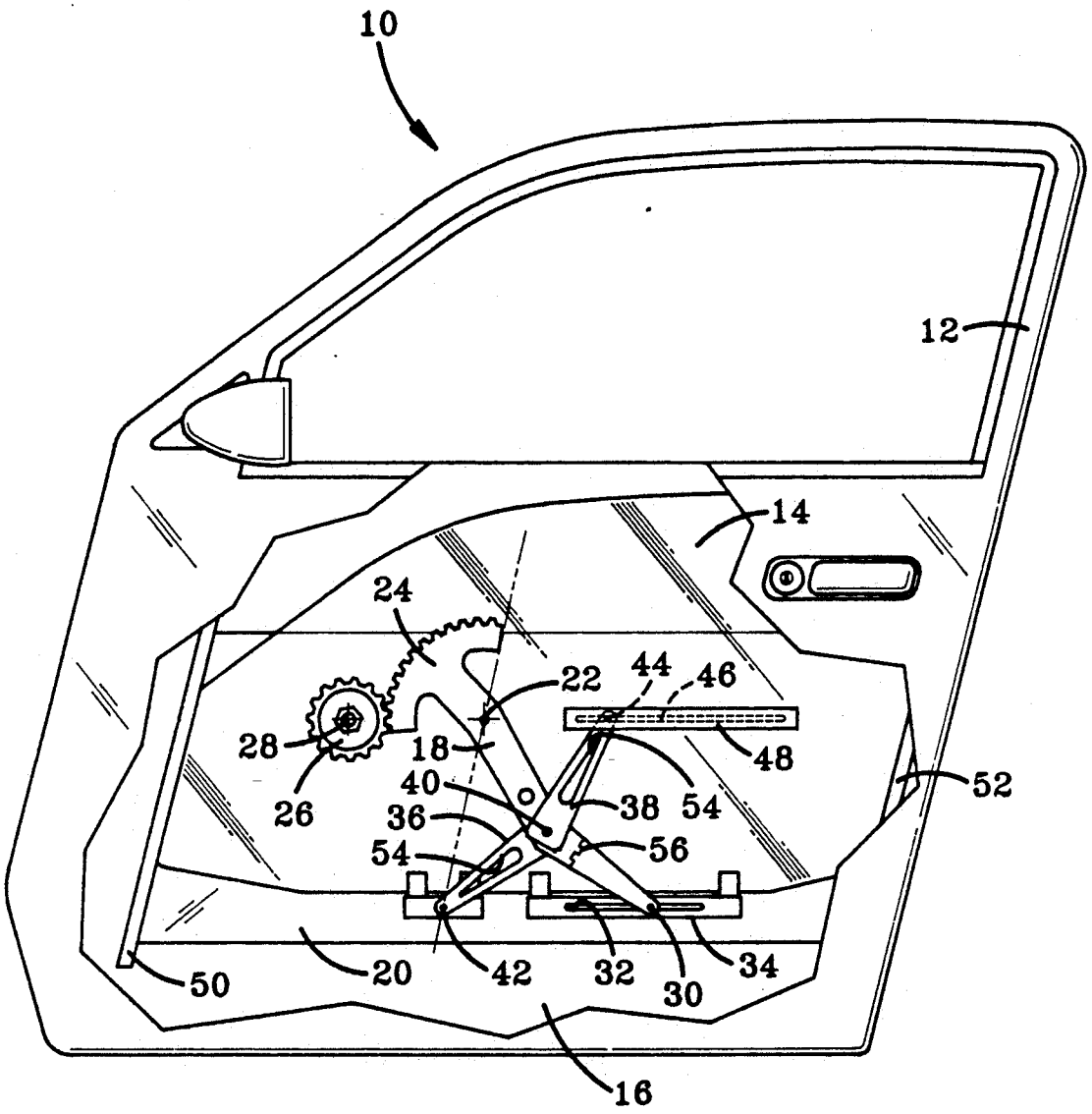
FIG. 5 is a side elevation view of an alternative embodiment of the door window regulator showing additional aspects of the invention.

Referring to the Figs. and particularly to FIG. 1, a vehicle door 10 having an angled B-pillar 12 is shown. The door 10 has a movable window pane 14 which is shown fully retracted into a door cavity 16. A door window regulator for raising and lowering the glass pane 14 has a bent or curved lift arm 18 which is pivotally connected at one end, to an interior base panel 20 by a shaft 22. A segment gear 24 integrally attached to the lift arm 18 at the end nearest the pivot point of the lift arm has an arcuate row of teeth which mesh with the teeth of pinion 26 connected to base panel 20 by pinion shaft 28. Pinion 26 is operatively connected in a conventional manner to a motor (not shown) or a manual crank (not shown) to effect rotation of the pinion 26 and the lift arm 18. The end of the lift arm opposite the segment gear 24 carries a roller or pin 30 which pivotally and slidably rides along a guideway or channel 32 of a guide element 34 fixedly connected to the window pane 14. Each of a pair of balance arms 36 and 38 is pivotally connected at one end to a central pivot pin 40 at a point on the lift arm 18 intermediate between the pin 30 and shaft 22. The central pivot point 40 is preferably located so that it is always near a vertical plane perpendicular with, and passing through the center of mass of the window pane, regardless of the extent to which the window pane has been raised or lowered. A roller or pin 42 at the other end of forward balance arm 36 pivotally, and optionally slidably engages a guideway or channel 32 of guide element 34, while the other end of rearward balance arm 38 carries a roller or pin 44 which pivotally and slidably engages a guideway or channel 46 of a guide element 48 secured to the base panel 20. While the forward balance arm 36 is pivotally, and optionally slidably, engaging a guideway 32, in the preferred embodiment, to allow for greater adjustability and/or flexibility, the forward balance arm can be pivotally secured to the window as shown in FIG. 5. The guideways or channels 32 and 46 are substantially linear and preferably arranged so that the longitudinal axes of the channels are substantially horizontal.

Figure 2:
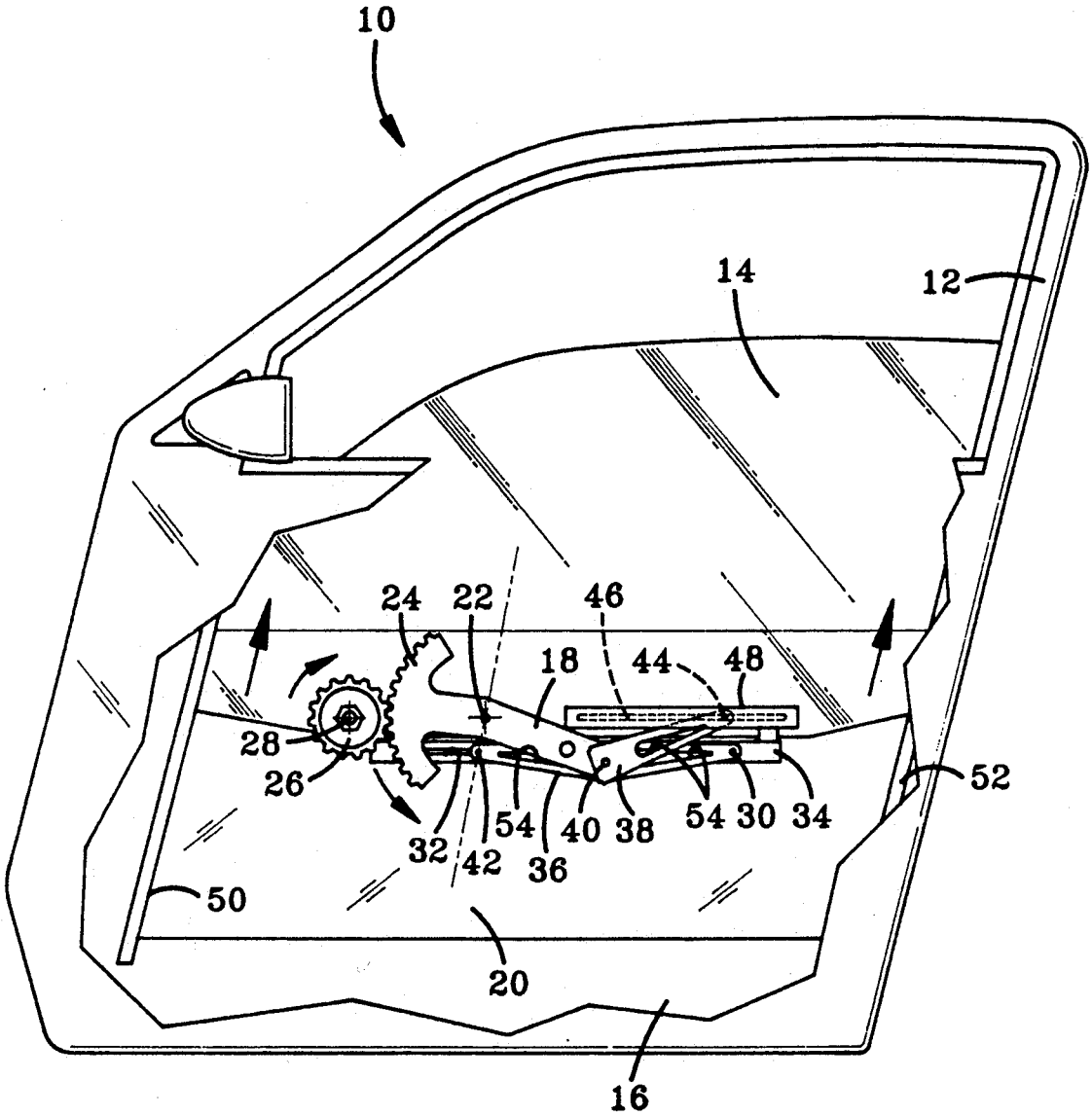
FIG. 2 is a side elevation view o the vehicle door of FIG. 1 with portions broken away to show the door window regulator with the glass in an intermediate position between fully raised and fully lowered.

Referring to FIG. 2, arrows are used to indicate generally the direction of motion of the glass and various regulator components when the glass pane is being raised. Clockwise rotation of the pinion 26 causes the segment gear 24 to move in a counter clockwise direction which in turn causes the other end of the lift arm 18 to rotate upwardly about shaft 22 lifting the window pane 14. Forward and rearward glass-run channels 50 and 52, respectively, guide the forward and rearward edges of the window pane 14 as it is being raised or lowered.

The bend of the lift arm 18 is formed by two nonparallel substantially linear segments and is defined such that a line connecting the pivot point at shaft 22 with the balance point at pivot pin 40 (arm segment A) forms an angle with a line connecting the balance point to pin 30 (arm segment B). This lift arm angle is generally between 90° and 180°. Preferably, the sum of the lift arm angle and the angle formed by the B-pillar with the vertical is about 180°.

The radially distal portion of the lift arm 18 (arm segment B) is preferably about equal in length to the forward balance arm, while the proximal portion of the lift arm (arm segment A) is preferably about equal in length to the rearward balance arm, so that the balance point at pin 40 is situated substantially directly below the center of mass of the window pane 14, regardless of the extent to which the glass pane has been raised or lowered. In accordance with the most preferred mode of the invention, both balance arms 36 and 38 and both portions of the lift arm are all of equal length, with the regulator components arranged so that the lift arm angle is about equal to the angle formed by the two balance arms regardless of the extent to which the window pane has been raised or lowered.

Figure 3:
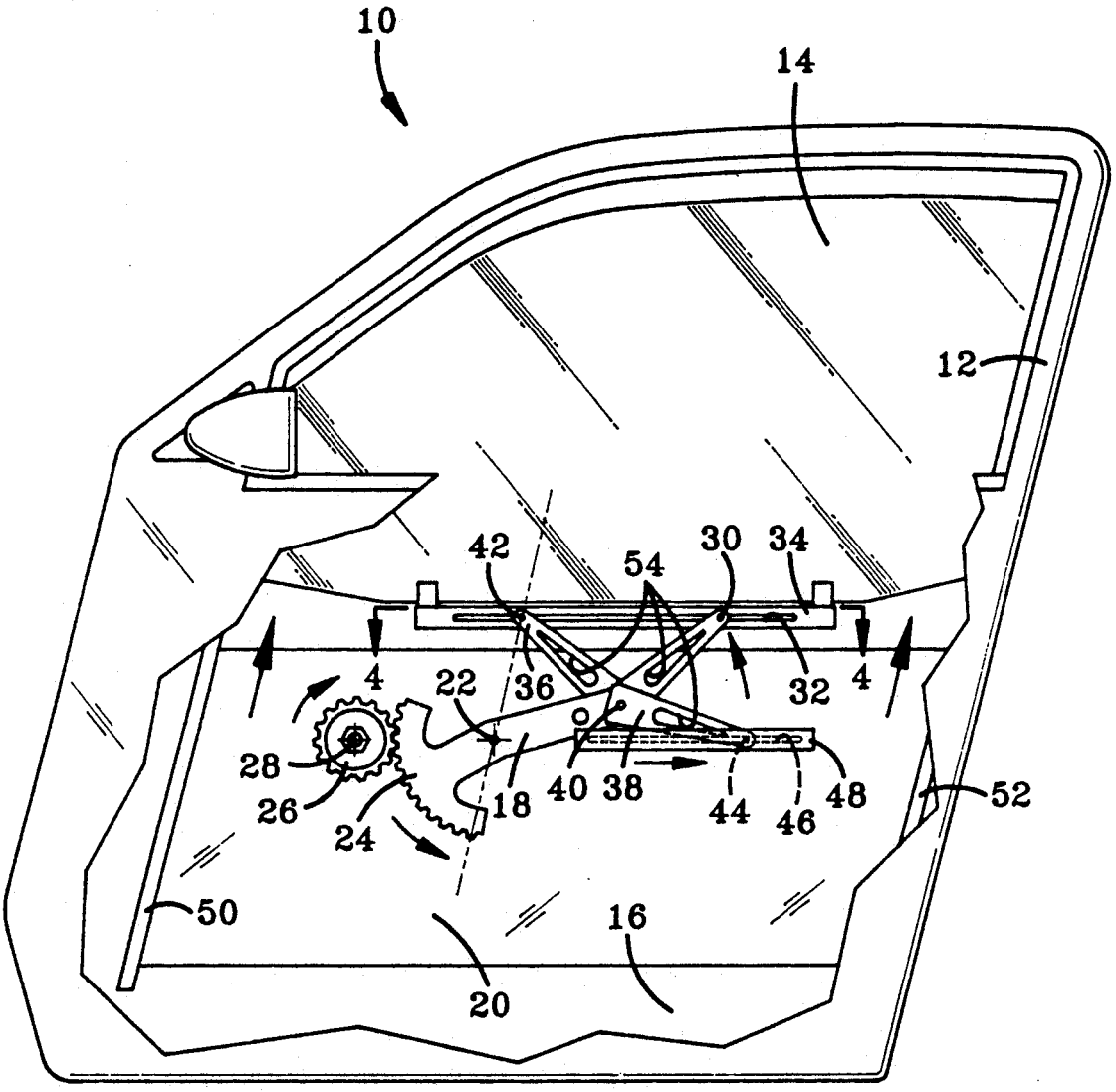
FIG. 3 is a side elevation view of the vehicle door of FIG. 1 with portions broken away to show the door window regulator with the glass almost in the fully raised position.

A characteristic of the door window regulator disclosed herein is that the pivot point of the forward balance arm which is connected to the window pane travels along a substantially linear path which is substantially parallel with the slanted window opening edge of the B-pillar during raising or lowering of the window pane. This characteristic of the invention is most clearly illustrated in FIGS. 1–3, wherein the orientation of the regulator components and the window pane fully lowered at an intermediate position, and almost fully raised, are shown respectively. The forward balance arm 36 in cooperation with the other regulator components thus ensures that as the window pane is raised or lowered, the attitude of the window pane remains substantially constant with respect to the door and that the window is guided along a linear path substantially parallel with the slanted window opening edge of the B-pillar. The window pane maintains a constant attitude by virtue of geometric relationship of the lift arm 18 and the forward balance arm 36. In particular, the lengths of the distal arm segment B and of forward balance arm 36, as measured from the central pivot point 40 to the sliding pivot point at which the lift arm is connected to the window pane and the stationary pivot point at which the forward balance arm is connected to the window pane respectively, are of substantially equal length. The arm lengths in association with the bend of the lift arm cooperate to keep the window pane level and to smoothly direct it along a linear path parallel to the window opening edge of the B-pillar.

The smooth tracking of the window parallel to the window opening edge of the B-pillar reduces fore and aft stresses at the edges of the window. However, with a curved window having an axis of curvature parallel with the normal direction of forward motion of the vehicle, there is an interaction between fore/aft stresses and inboard/outboard stresses. Therefore, for curved windows, the smooth tracking of the window parallel to the window opening edge of the B-pillar also helps to reduce inboard and outboard stresses on the glass channel runs and weatherstrips.

Figure 4:
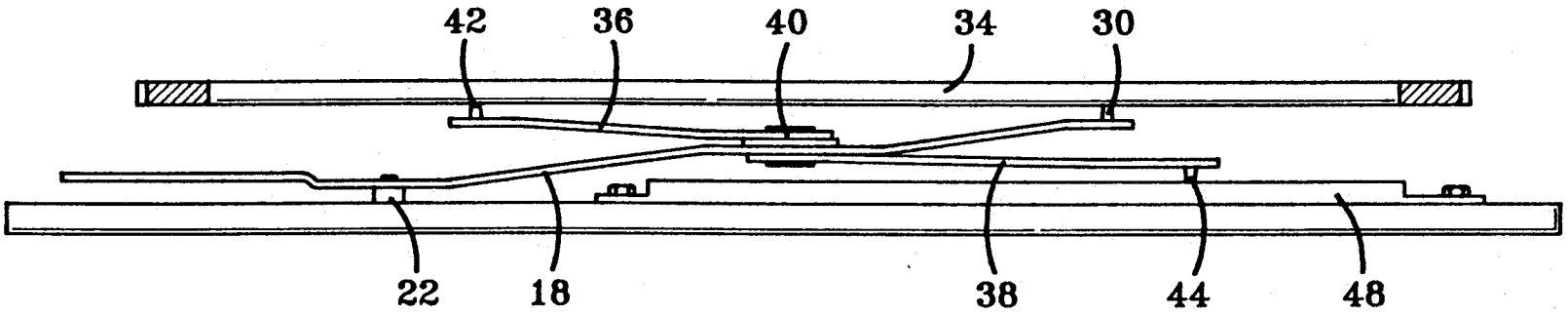
FIG. 4 is a fragmentary sectional plan as viewed along lines 4–4 of FIG. 3.

In order to further reduce inboard and outboard stresses on the glass-runs, glass-run weather strips, and the regulator components, particularly when a curved window pane having an axis of curvature parallel to the normal direction of forward motion of the vehicle is used, the central pivot point 40 is centrally located in the door cavity substantially equidistance between the vertical planes coincident with the longitudinal directions of the guide elements 34 and 48 as shown in FIG. 4. This central positioning of the pivot point 40 provides for better balancing of the window pane on the regulator and thereby aids in reducing inboard and outboard stresses, as well as fore and aft stresses.

Inboard and outboard stresses can be further reduced by increasing the flexibility of the lift arms by providing them with holes, slots or cutouts 54, or by providing them with hinges 56 as shown in FIG. 5.

While in accordance with the Patent Statutes, the best mode and preferred embodiment has been set forth, the scope of the invention is not limited thereto, but rather by the scope of the attached claims.

What is claimed is:

1. A vehicle door window regulator for a window having a rearward edge which tracks along a path parallel with the window opening edge of a B-pillar, comprising: a lift arm (18) pivotally connected to a fixed point (22) on the door at one end and pivotally and slidably engaging a guideway (32) secured to a window pane (14) at a sliding pivot point (30) on the other end, said lift arm (18) having two nonparallel, substantially linear segments which form an obtuse angle which defines a bend in said lift arm (18); a pair of balance arms (36 and 38), each of which is connected at one end to a central pivot point (40) near the bend of said lift (18), one of the balance arms (36) at its other end pivotally secured to the window pane (14), the second balance arm (38) at its other end pivotally and slidably engaging a guideway (46) secured to the door; and means for rotating said lift arm (18) about said fixed pivot point (22) on the door to raise and lower the window pane (14); the regulator components being arranged so that regardless of the position of the window pane (14) relative to the door, the balance arms (36 and 38) form an angle approximately equal to the obtuse angle formed by the bend of the lift arm.

2. A vehicle door window regulator in accordance with claim 1, wherein said guideways (32 and 46) are linear and substantially horizontally arranged.

3. A vehicle door window regulator in accordance with claim 1, wherein the sum of said obtuse angle and the angle between a vertical line and the window opening edge of a B-pillar (12) is equal to about 180° degrees.

4. A vehicle door window regulator in accordance with claim 3, wherein the two segments of the lift arm (18) are of substantially equal length, the lengths of said segments being defined, respectively, by the distance between the central pivot point (40) near the bend of said lift arm (18) and the fixed pivot point (22) on the door to which the lift arm (18) is connected, and by the distance between the central pivot point (40) near the bend of said lift arm (18) and the sliding pivot point (30) by which the lift arm (18) engages the guideway (32) secured to the window pane (14).

5. A vehicle door window regulator in accordance with claim 4, wherein said balance arms (36 and 38) are of substantially equal length, the length of said balance arms (36 and 38) being defined, respectively, by the distance between the central pivot point (40) to which each balance arm (36 and 38) is connected to the lift arm (18) and the sliding pivot point (42) at which the first balance arm engages the guideway (32) secured to the window pane (14), and by the distance between the central pivot point (40) to which each balance arm (36 and 38) is connected to the lift arm (18) and the sliding pivot point (30) at which the second balance arm (38) engages the guideway (46) secured to the door.

6. A vehicle door window regulator in accordance with claim 5, wherein each of said balance arms (36 and 38) has a length substantially equal to the length of each of said lift arm (18) segments.

7. A vehicle door window regulator in accordance with claim 1, wherein the balance arms (36 and 38) are separately pivotally connected to opposite sides of the lift arm (18).

8. A vehicle door window regulator in accordance with claim 7, wherein the central pivot point (40) at which the balance arms (36 and 38) are connected to the lift arm (18) is centrally located in the door cavity substantially equidistance between the vertical planes coincident with the longitudinal directions of the guideways (32 and 46).

9. A vehicle door window regulator in accordance with claim 1, wherein the lift arm (18) and the balance arms (36 and 38) are provided with cutouts (54) to increase the flexibility of said arms (18, 36 and 38).

10. A vehicle door window regulator for a window having a rearward edge which tracks along a path parallel with the window opening edge of a B-pillar, comprising a bent lift arm (18) pivotally connected to the door at one end, and pivotally and slidably engaging a guideway (32) connected to a window pane (14) at a sliding pivot point (30) on the other end; two balance arms (36 and 38), each pivotally connected at one end to a central pivot point (40) on the lift arm (18), the central pivot point (40) being at an intermediate position near the bend of the lift arm (18), one of the balance arms (36), at its other end pivotally, and optionally slidably, connected to the window pane (14), the second balance arm at its other end door; and means for rotating the lift arm (18) connected to the door; and means for rotating the lift arm (18) about the pivot point (22) on the door to raise and lower the window pane (14); the regulator components being arranged so that the balance arms (36 and 38) form an angle approximately equal to the angle formed by the bend in the lift arm (18).

11. A regulator as set forth in claim 10, wherein the balance arms (36 and 38) are approximately of equal length.

12. A regulator as set forth in claim 11, wherein the segment of the lift arm (18) extending from the pivot point (22) on the door to the central pivot point (40) is approximately equal in length to the segment of the lift arm extending from the central pivot point (40) to the sliding pivot point (30) on the window pane (14).

13. A regulator as set forth in claim 11, wherein the sum of the angles defining the bend of the lift arm (18) and an angle between the window aperture edge of the door B-pillar and a vertical line (12) is approximately equal to 180 degrees.

14. A regulator as set forth in claim 10, wherein the balance arms (36 and 38) are separately pivotally connected to opposite sides of the lift arm (18).

15. A regulator as set forth in claim 14, wherein the central pivot point (40) at which the balance arms (36 and 38) are connected to the lift arm (18) is centrally located in the door cavity substantially equidistance between the vertical planes coincident with the longitudinal directions of the guide elements (32 and 46).

16. A regulator as set forth in claim 10, wherein the lift arm (18) and the balance arms (36 and are provided with cutouts (54) to increase the flexibility of said arms (18, 36 and 38).

17. A vehicle door window regulator for a window having a rearward edge which tracks along a path parallel with the window opening edge of a B-pillar, comprising: a lift arm (18) pivotally connected to a fixed point (22) on the door at one end and pivotally and slidably engaging a guideway (32) secured to a window pane (14) at a sliding pivot point (30) on the other end; a pair of balance arms (36 and 38) each of which is pivotally connected at one end to a central pivot point (40) intermediate between the ends of said lift arm (18)(, said central pivot point (40) being offset away from an imaginary line connecting the lift arm fixed pivot point (22) to the lift arm sliding pivot point (30) such that an imaginary line connecting the lift arm fixed pivot point (22) with the central pivot point (40) forms an obtuse angle with an imaginary line connecting the central pivot point (40) with the lift arm sliding pivot point (30), one of said balance arms (38) at its other end pivotally and slidably, engaging a linear guideway (46) secured to the door, the second balance arm (36) at its other end pivotally secured to the window pane (14); and means for rotating said lift arm (18) about said fixed pivot point (22) on the door to raise and lower the window pane (14); the sum of said obtuse angle and the angle between a vertical line and the window opening edge of a B-pillar (12) being equal to about 180° degrees.

* * * * *

UNITED STATES PATENT AND TRADEMARK OFFICE

CERTIFICATE OF CORRECTION

PATENT NO. : 5,255,470

DATED : October 26, 1993

INVENTOR(S) : Ronald E. Dupuy

It is certified that error appears in the above-indentified patent and that said Letters Patent is hereby corrected as shown below:

Column 5, line 28, insert the word "arm" after the word "lift".

Signed and Sealed this

Nineteenth Day of April, 1994

Bruce Lehman

*Attest:*

BRUCE LEHMAN

*Attesting Officer*

*Commissioner of Patents and Trademarks*